United States Patent [19]

Hand

[11] 4,070,858

[45] Jan. 31, 1978

[54] BRAKE AND STEERING SYSTEM

[75] Inventor: Gene F. Hand, Stevensville, Mich.

[73] Assignee: Clark Equipment Company, Buchanan, Mich.

[21] Appl. No.: 816,241

[22] Filed: July 18, 1977

Related U.S. Application Data

[63] Continuation-in-part of Ser. No. 729,926, Oct. 6, 1976, abandoned.

[51] Int. Cl.[2] ..... F15B 11/20

[52] U.S. Cl. ..... 60/422; 60/478; 60/484; 91/412; 137/101

[58] Field of Search ..... 60/386, 403, 422, 478, 60/484; 91/412; 137/101

[56] References Cited

U.S. PATENT DOCUMENTS

| | | | |
|---|---|---|---|
| 2,597,050 | 5/1952 | Audemar | 60/536 |
| 2,737,196 | 3/1956 | Eames | 60/422 X |
| 3,411,293 | 11/1968 | Akins | 60/454 |
| 3,941,142 | 3/1976 | Adachi et al. | 60/422 X |

*Primary Examiner*—Edgar W. Geoghegan
*Attorney, Agent, or Firm*—Kenneth C. Witt

[57] ABSTRACT

A combined brake and steering system for a vehicle having hydraulic braking and hydraulic steering. A single pump is utilized to supply both the brakes and steering. Two priority valves are arranged to assure that the brakes take precedence and receive an approximately constant flow of hydraulic fluid subject to a predetermined maximum pressure. The steering mechanism also normally receives a constant flow, subject to a different maximum pressure. The fluid from the steering mechanism is recirculated through a reservoir back to the pump. The fluid from the brakes is recirculated to the pump without going through the reservoir.

6 Claims, 1 Drawing Figure

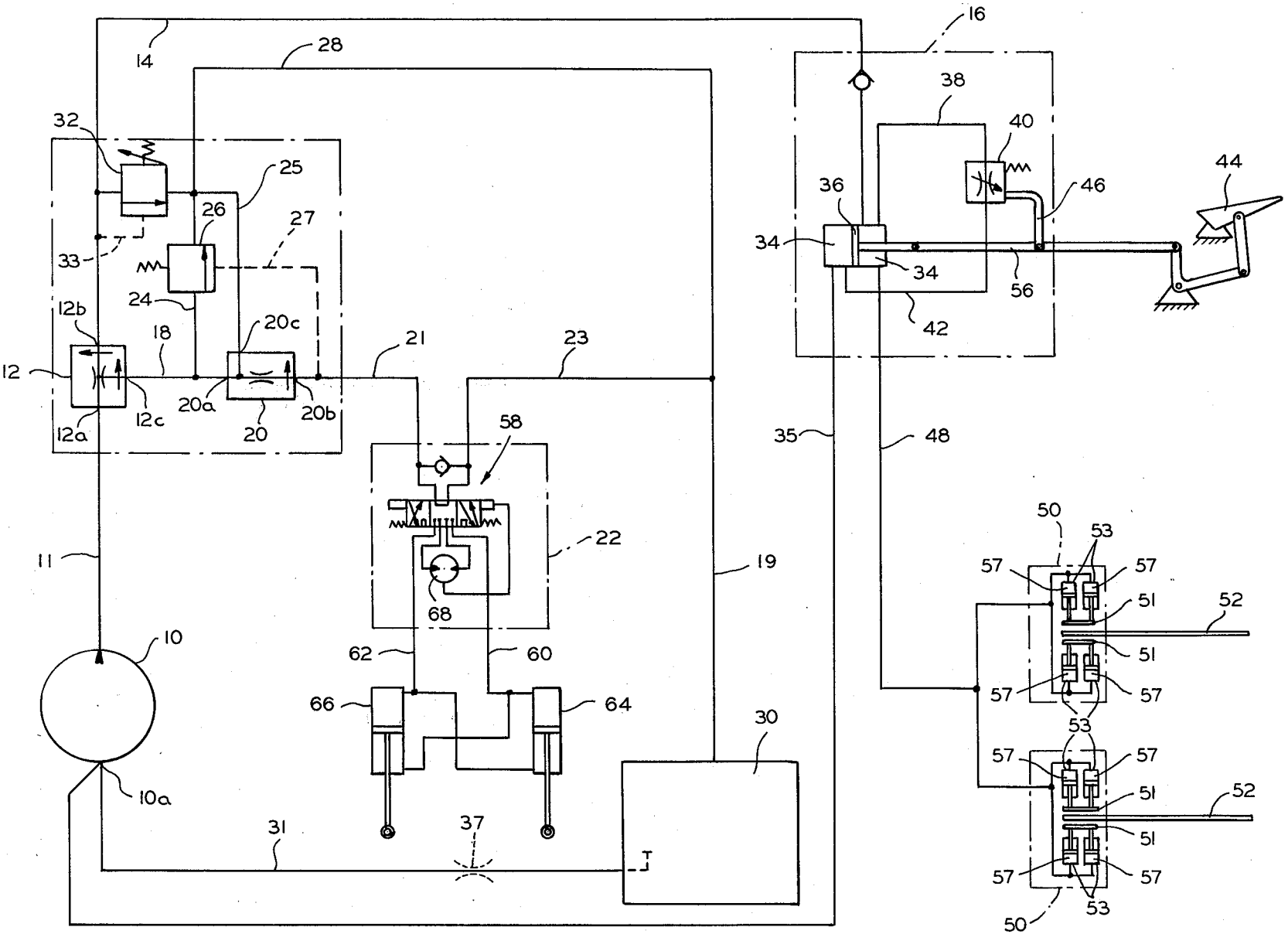
44
46
40
56
16
38
34
42
36
34
35
48
52
52
57
51
51
57
53
53
50
57
57
57
57
50
19
30
T
22
64
23
60
58
37
68
21
62
66
28
25
27
20b
20c
20
26
20a
24
18
12c
14
10
10a
32
33
12b
12a
12
11
31

BRAKE AND STEERING SYSTEM

This is a continuation-in-part of U.S. patent application Ser. No. 729,926, filed Oct. 6, 1976 now abandoned.

BACKGROUND OF THE INVENTION

1. Field of the Invention:

This invention relates to combined brake and steering hydraulic systems for vehicles having hydraulic brakes and hydraulic steering, and is particularly advantageous for articulated vehicles which require a relatively large flow of hydraulic fluid in the operation of the steering mechanism.

2. Description of the Prior Art:

Articulated vehicles, as referred to herein, comprise two separate frame portions, with the two frame portions connected by a combined draft and steering coupling. In order to steer such a vehicle it is necessary to turn one frame portion with respect to the other and this is commonly done by means of hydraulic actuators or jacks connected between the two frame portions.

Various kinds of brakes have been used for such vehicles, including pneumatic, combined pneumatic and hydraulic, full hydraulic and others. It is advantageous for many such vehicles to utilize hydraulic brakes and to employ a combined hydraulic steering and braking system.

In larger articulated vehicles it is common to utilize separate pumps to supply the steering system and the braking system, and it is known also to utilize three pumps, with the third pump arranged to be shifted between the steering and braking systems under various operating conditions.

For smaller articulated vehicles particularly it is advantageous to be able to utilize a single hydraulic pump to supply both the braking and steering systems, and the object of the present invention is to provide an improved system of this type.

SUMMARY OF THE INVENTION

In carrying out this invention in one preferred form, an open center type combined brake and steering hydraulic system for a vehicle is provided which includes a hydraulic pump on the vehicle arranged to supply at least a minimum flow of fluid to maintain adequate steering and braking whenever the vehicle is in normal operation. A first priority valve has its inlet connected to receive the entire output of the pump. The first priority valve has two outlets. The first of these outlets, during operation, discharges an approximately constant flow of fluid, for operating the hydraulic brakes on the vehicle. The fluid from the second outlet of the first priority valve enters a second priority valve. One outlet from the second priority valve supplies the hydraulic steering valve of the vehicle a normally constant flow, while the other outlet from the second priority valve discharges the remainder of the fluid emanating from the pump. The fluid from the brakes is recirculated directly to the pump whereas the remainder of the fluid is recirculated through a reservoir to the pump.

BRIEF DESCRIPTION OF THE DRAWING

The single FIGURE of the drawing is a schematic diagram of a system embodying this invention.

DESCRIPTION OF THE PREFERRED EMBODIMENT

On the drawing, the numeral 10 indicates a constant displacement pump which supplies the combined brake and steering system of this invention. The pump 10 may be operated by the engine of the vehicle in which the present system is embodied and may operate over a range of speeds varying from the engine idling to the maximum engine speed condition.

The entire output of the pump 10 is discharged through a conduit 11 and into the inlet **12*a* of a priority valve 12 of known type. Priority valve 12 has two outlets, a regulated flow outlet indicated at 12*b* and a by-pass flow outlet indicated at 12*c*. The priority valve 12 is of the pressure compensated type and the flow from outlet 12*b* has priority. That is, in a system as shown and under normal operating conditions the fluid flow from outlet 12*b* is maintained at an approximately constant rate regardless of the pressure and/or flow from outlet 12*c***.

As an example, in a typical vehicle, the flow from outlet **12*b* may be approximately 2.5 gallons per minute from a pump 10**, the output of which may vary from 8 gallons per minute at 700 rpm, the engine idling speed, to 28 gallons maximum per minute at 2300 rpm, the governed speed. The normal operating range for the engine of such vehicle is considered to be between approximately 700 rpm (at which the flow is approximately 8 gpm) and 2300 rpm (at which the flow is approximately 28 gpm).

The flow from outlet **12*b* passes through a conduit 14 to and through an open center brake mechanism of known type indicated generally by the numeral 16, and leaves brake mechanism 16 through conduit 35 and then flows directly to the inlet 10*a* of pump 10, by-passing a reservoir 30** which is described later.

From the by-pass outlet **12*c* of the priority valve 12 hydraulic fluid flows through a conduit 18 into the inlet 20*a* of a second priority valve 20. Priority valve 20 has a regulated flow outlet 20*b* which, under some operating conditions, discharges an approximately constant flow of fluid into conduit 21 whence it flows through a steering mechanism 22 and conduits 23 and 19 to the reservoir 30. When the engine is idling the flow from regulated outlet 20*b*** may be less than the constant amount as explained hereinafter.

The remainder of the fluid entering priority valve 20 is discharged from the second by-pass or outlet **20*c* through conduit 25 which connects with a conduit 28 and thereby returns such fluid through the conduit 19 to the reservoir 30. From the reservoir 30 hydraulic fluid recirculates through conduit 31 to the inlet 10*a*** of the pump.

The discharge from the regulated outlet **20*b* of the priority valve 20 may be, for example, approximately 12 gallons per minute. This means that when the engine is in the normal operating range, as defined herein, the discharge through by-pass outlet 20*c* and conduit 25 will vary from a minimum amount of 0 gpm up to 13.5 gpm. With the engine idling at 700 rpm, however, the flow from the priority valve 20 through steering valve 22 will be about 5.5 gallons per minute. Whenever the speed of the engine and pump results in a flow of less than 12 gpm through the steering mechanism 22** the speed of steering is correspondingly less, but adequate for the conditions.

Although the brake mechanism as such is not a part of the present invention a brief explanation of its operation will facilitate an understanding of the present invention. When the pump 10 is in operation and no braking is taking place the constant flow of fluid through outlet 12*b* and conduit 14 enters the chamber 34 to the right of piston 36 and then flows through conduit 38 and adjustable valve 40 through a conduit 42 into the left end of chamber 34 and then to conduit 35 and back to the pump 10.

The operation of the foot pedal 44 by the operator, through linkage 46 closes valve 40 an amount depending upon the amount pedal 44 is depressed and applies the brakes a corresponding amount by directing hydraulic fluid under pressure through conduit 48 to disc brakes indicated generally at 50. Each of the two brakes shown comprises a rotor indicated at 52 and discs 51 and hydraulic actuators 53 on both sides of each rotor connected to and operating the respective discs.

Each of the brake actuators 53 includes a chamber 57 which is pressurized by pressure from conduit 48 to apply the brakes. It will be appreciated that when the brakes are not being applied it is desirable to minimize the residual pressure in chambers 57 in order to minimize wear on the discs and rotors when the brakes are not being utilized, and that present system accomplishes this in a combined brake and steering system utilizing a single pump.

The brake mechanism 16 has an emergency feature whereby if there should be a failure in hydraulic pump 10 or conduit 14, for example, and consequent loss of incoming fluid, the movement of the pedal 44, through link 56, moves piston 36 to the right to trap fluid in the right end of chamber 34 and through continued movement of pedal 44 applies pressure to the chambers 57 in brakes 50 through conduit 48.

The steering mechanism 22 likewise is of known type but an explanation of its operation it is believed also will facilitate an understanding of the operation of the present invention. Movement of the operator's steering wheel on the vehicle moves a valve spool indicated at 58 either to the right or left depending upon the desired direction of steering. This causes the flow of fluid under pressure through either conduit 60 or 62 to a pair of hydraulic actuators or jacks indicated generally at 64 and 66. These are connected in push-pull relation so that the flow of pressurized fluid through conduit 60, for example, extends actuator 64 and simultaneously contracts actuator 66, with conduit 62 serving as the return conduit. Conversely, the flow of pressurized fluid through conduit 62 extends actuator 66 and contracts actuator 64, and conduit 60 serves as the return conduit. Such operation of the actuators pivots one frame portion of the vehicle with respect to the other in the desired direction and accordingly produces steering in the selected direction.

As shown, the steering mechanism 22 also includes an emergency manually operated pump 68 which is arranged to operate the steering actuators 64 and 66 in the event of failure of the pump 10 or any of the elements in the hydraulic circuit between the pump and steering mechanism 22.

A relief valve 32 is connected between conduits 14 and conduit 28 for a purpose to be explained, and a similar relief valve 26 is connected by conduit 24 between conduit 18 and conduit 28.

In the operation of this system, whenever the pump 10 is in operation, whether the engine is idling or running at a greater operating speed, the specified constant flow of hydraulic fluid flows from outlet 12*b* of priority valve 12 through conduit 14 and through brake mechanism 16 and back to the pump. When the operator applies the brakes by operating pedal 44 the amount of application of the brakes depends upon the amount of operation of the pedal and consequently upon the amount of closing of valve 40. Thus, a varying pressure, dependent upon the operator, is applied to the brakes, up to a maximum pressure which is determined by relief valve 32, and this may, for example, be set at 2,000 pounds per square inch. A pressure sensing connection for operating the relief valve 32 responsively to the pressure in conduit 14 and at outlet 12*b* is indicated at 33.

All of the flow from the pump 10 enters priority valve 12 and except for the relatively small regulated amount which is discharged through outlet 12*b*, is discharged from priority valve 12 through by-pass outlet 12*c*. Thence, under normal operating conditions the flow from outlet 12*c* enters the inlet 20*a* of priority valve 20. In the example given of a typical vehicle embodying the present invention a regulated amount of approximately 12 gallons per minute (or less under some circumstances) is discharged through regulated outlet 20*b* while the remainder of the fluid (if any) from the pump 10 is discharged from by-pass port 20*c* and returns to the reservoir.

The pressure which is available for operation of the steering mechanism is determined by the relief valve 26, and this may be set, for example, at 1600 psi. As shown, the pressure sensing connection 27 for the relief valve is connected to reflect the pressure at regulated outlet 20*b*.

In operation, if neither the brake mechanism nor the steering mechanism is in operation, the flow from pump 10 passes through both such mechanisms with little resistance, at a negligible pressure drop, and consequently little energy is required to operate pump 10 under such circumstances as is typical for an open center system.

When steering occurs, the pump 10 then must operate against a pressure which may reach a maximum of 1600 psi and this, of course, requires considerably more energy. It will be appreciated that the actual pressure reached in the steering portion of the system is dependent upon the conditions under which steering takes place.

When braking occurs the pressure in the braking portion of the system may rise to 2000 psi and such pressure is reflected back to the priority valve 12 and the pump 10 and the energy required to pump all of the fluid handled by the pump increases accordingly. In a typical situation the pressure drop between inlet 12*a* and regulated flow outlet 12*b* is 70 psi; thus when the pressure at 12*b* is 2000 psi the pressure at inlet 12*a* and at the pump 10 is 2070 psi.

It will be appreciated that the present system makes possible reduced energy consumption because except for intervals involving braking during which the pressure in the braking portion of the system exceeds 1600 psi the pump 10 is required to operate at a maximum pressure of 1600 psi, such condition occurring during operation of the steering mechanism. Nevertheless, the maximum pressure of 2000 psi is available for the braking mechanism when needed.

The present invention is not limited to a system in which the maximum pressure in the braking portion of the system is greater than the maximum pressure in the steering portion but is applicable also if the two are equal or if the former is less than the latter.

In the system described and illustrated herein the reservoir 30 is of completely closed construction and is maintained at a super (above) atmospheric pressure which is approximately 7 psi under normal operating conditions. The suction pressure at the inlet 10*a* of the pump 10 is maintained at less than the pressure in the reservoir 30 although it still is normally greater than atmospheric pressure. However, it will be appreciated that the pressure in both reservoir 30 and at the inlet 10*a* of the pump may become less than atmospheric under certain operating conditions.

There is shown in the drawing, in phantom, an orifice or restriction 37 in suction line 31 from the reservoir 30 to the inlet 10*a* of the pump, to indicate that there is a pressure drop between the reservoir and inlet 10*a* where the discharge line 35 from the brake mechanism is connected. Actually, it was found in testing this invention that a separate restriction 37 was not required to achieve the necessary predetermined pressure difference. The piping which was used for conduit 31 produced a pressure drop between the reservoir and location 10*a* of 2–3 psi and this was sufficient to achieve the benefits of the present invention. In some circumstances a separate orifice or restriction may be required, although in most cases proper selection of the pipe size can be utilized to achieve the desired pressure drop.

Thus, while I have described and illustrated herein the best mode contemplated of carrying out my invention it will be appreciated that modifications may be made. Accordingly, it should be understood that I intend to cover by the appended claims all such modifications which fall within the true spirit and scope of my invention.

I claim:

1. A combined brake and steering hydraulic system for a vehicle, comprising a hydraulic pump supplying pressurized hydraulic fluid, an open center hydraulic brake mechanism, an open center hydraulic steering mechanism, a priority valve receiving the entire fluid output of the said pump and discharging a first portion of said fluid into the said hydraulic brake mechanism and an additional portion into the said hydraulic steering mechanism, a reservoir, conduit means discharging the fluid from the said hydraulic steering mechanism into the said reservoir, additional conduit means conducting fluid from said reservoir to said hydraulic pump with a predetermined pressure drop, and means conducting the fluid discharged from said hydraulic brake mechanism to said pump by-passing the said reservoir and entering the pump at a pressure lower than the pressure in the reservoir by the amount of the said predetermined pressure drop.

2. A system as in claim 1 in which the said reservoir is maintained at a super-atmospheric pressure under normal operating conditions.

3. A combined brake and steering hydraulic system for a vehicle, comprising a hydraulic pump supplying pressurized hydraulic fluid, an open center hydraulic brake mechanism, a priority valve receiving the entire fluid output of the said pump and discharging an approximately constant flow portion of said fluid to the said hydraulic brake mechanism, an open center hydraulic steering mechanism, at least a portion of the remainder of the fluid from said priority valve flowing through the said hydraulic steering mechanism, means for limiting the pressure in the system resulting from the operation of the hydraulic brake mechanism to a predetermined amount, separate means for limiting the pressure in the system produced by the steering mechanism to a lesser amount, a reservoir, conduit means conducting the fluid discharged from the hydraulic steering mechanism into the said reservoir, a conduit connecting the reservoir to supply fluid to the said pump, and means directing the fluid discharged from said hydraulic brake mechanism to the said pump, by-passing the said reservoir.

4. A system as in claim 3 in which the said reservoir is maintained at a super-atmospheric pressure under normal operating conditions.

5. A combined brake and steering hydraulic system for a vehicle, comprising a hydraulic pump supplying pressurized hydraulic fluid, an open center hydraulic brake mechanism, a priority valve receiving the entire fluid output of the said pump and discharging an approximately constant flow portion of said fluid to the said hydraulic brake mechanism, an open center hydraulic steering mechanism, at least a portion of the remainder of the fluid from said priority valve flowing through the said hydraulic steering mechanism, means for limiting the pressure in the system resulting from the operation of the hydraulic brake mechanism to a predetermined amount, separate means for limiting the pressure in the system produced by the steering mechanism to the same or a different amount, a reservoir, conduit means conducting the fluid discharged from the hydraulic steering mechanism into the said reservoir, a conduit connecting the reservoir to supply fluid to the said pump, and means directing the fluid discharged from said hydraulic brake mechanism to the said pump, by-passing the said reservoir.

6. A system as in claim 5 in which the said reservoir is maintained at a super-atmospheric pressure under normal operating conditions.

* * * * *